US008157554B2

(12) United States Patent
Petras et al.

(10) Patent No.: US 8,157,554 B2
(45) Date of Patent: Apr. 17, 2012

(54) ROTARY SPINNING ELECTRODE

(75) Inventors: David Petras, Pertoltice (CZ); Miroslav Maly, Visnova (CZ); Jan Pozner, Liberec (CZ); Jan Trdlicka, Trebon (CZ); Martin Kovac, Cenkov (CZ)

(73) Assignees: Elmarco S.R.O. (CZ); Jan Pozner (CZ); Jan Trdlicka (CZ)

( * ) Notice: Subject to any disclaimer, the term of this patent is extended or adjusted under 35 U.S.C. 154(b) by 460 days.

(21) Appl. No.: 12/439,732

(22) PCT Filed: Aug. 24, 2007

(86) PCT No.: PCT/CZ2007/000082

§ 371 (c)(1),
(2), (4) Date: Mar. 3, 2009

(87) PCT Pub. No.: WO2008/028428

PCT Pub. Date: Mar. 13, 2008

(65) Prior Publication Data

US 2010/0034914 A1 Feb. 11, 2010

(30) Foreign Application Priority Data

Sep. 4, 2006 (CZ) ..... 2006-545

(51) Int. Cl.
*D01D 5/00* (2006.01)

(52) U.S. Cl. ..... 425/6; 425/83.1; 425/174.8 E

(58) Field of Classification Search ..... 425/6, 8, 425/83.1, 174.8 E

See application file for complete search history.

(56) References Cited

U.S. PATENT DOCUMENTS 3,406,660 A * 10/1968 Simm ..... 118/626
4,287,139 A * 9/1981 Guignard ..... 264/10

FOREIGN PATENT DOCUMENTS

DE 101 36 255 A1 2/2003
GB 2 010 935 A 7/1979
WO WO 2005/024101 A1 3/2005

OTHER PUBLICATIONS

International Search Report dated Feb. 11, 2008, issued in corresponding international application No. PCT/CZ2007/000082.

P. Katta, et al., "Continuous Electrospinning of Aligned Polymer Nanofibers onto a Wire Drum Collector," Nano Letters, vol. 4, No. 11, Sep. 28, 2004, pp. 2215-2217.

* cited by examiner

*Primary Examiner* — Yogendra Gupta
*Assistant Examiner* — Joseph Leyson
(74) *Attorney, Agent, or Firm* — Ostrolenk Faber LLP

(57) ABSTRACT

The invention relates to the rotary spinning electrode of an elongated shape into the device for production of nanofibres through electrostatic spinning of polymer solutions comprising a pair of end faces, between them there are positioned spinning members formed by wire, which are distributed equally along the circumference and parallel with axis of rotation of the rotary spinning electrode, while the end faces are made of electrically non-conducting material and all the spinning members are mutually connected in a electrically conductive manner.

9 Claims, 2 Drawing Sheets

ROTARY SPINNING ELECTRODE

CROSS REFERENCE TO RELATED APPLICATIONS

The present application is a 35 U.S.C. §371 National Phase conversion of PCT/CZ2007/000082, filed Aug. 24, 2007, which claims benefit of Czech Application No. PV 2006-545, filed Sep. 4, 2006. The PCT International Application was published in the English language.

TECHNICAL FIELD

The invention relates to a rotary spinning electrode of an elongated shape for a device for production of nanofibres through electrostatic spinning of polymer solutions comprising a pair of end faces, between which are positioned spinning members formed by wire, which are distributed equally along the circumference and parallel with an axis of rotation of the rotary spinning electrode.

BACKGROUND ART

An example of known devices for production of nanofibres from polymer solution through electrostatic spinning, which contain a pivoted spinning electrode of an oblong shape, is disclosed in WO 2005/024101 A1. The device comprises the spinning electrode in the shape of a cylinder, which rotates around its main axis and a lower section of the surface is soaked into the polymer solution. Polymer solution is by a surface of the cylinder carried out into the electric field between the spinning and collecting electrode, where the nanofibres are created, which are carried away towards the collecting electrode and before it they deposit on a substrate material. This device is very capable of producing nanofibres from water polymer solutions. Nevertheless, the layer of nanofibres applied on the substrate material is not uniformly spread along the whole length of spinning electrode.

Greater uniformity of a produced layer of nanofibres is achieved through the device according to CZ PV 2005-360, that describes a spinning electrode comprising a system of lamellae arranged radially and longitudinally around the axis of rotation of a spinning electrode, while the coating surface of portions of the area of the spinning electrode, serving to carry the polymer solution into an electric field in a plane passing through an axis of the spinning electrode and perpendicular to a plane of substrate material, has a shape formed by an equipotential line of the electric field between the spinning electrode and collecting electrode of the highest intensity. Such a spinning electrode is able to carry out a sufficient quantity of polymer solution to the most suitable places of electric field between the spinning and collecting electrodes, and at the same time to spin also the non-water solutions of polymers and to produce a uniform layer of nanofibres. Nevertheless, demanding production requirements of such a spinning electrode, and consequently also its price represents its disadvantage.

DE 101 36 255 B4 discloses a device for production of fibres from polymer solution or polymer melt comprising at least two spinning electrode mechanisms, each of them being formed by a system of parallel wires mounted on a pair of continuous belts embraced around two guiding cylinders, which are positioned one above another, while the lower guiding cylinder extends into the polymer solution or molten polymer. Between these two spinning electrode mechanisms the textile is passed on a collecting electrode, while the spinning electrode mechanisms simultaneously create coating both on the front side and backside of the textile.

The spinning electrode is connected to a source of high voltage together with the collecting electrode, which is formed by an electrically conductive circulating belt. Polymer solution or polymer melt are carried out by means of wires into an electric field between the spinning electrode and the collecting electrode. In the electric field, the polymer solution or polymer melt produces fibres, which are carried to the collecting electrode and impinge on textile positioned on the collecting electrode. The length of time for which the polymer solution or polymer melt remains in the electric field represents a disadvantage, because the polymer solution as well as the polymer melt are subject to aging quite quickly, and during the spinning process it changes its properties, which results also in changes of parameters of produced fibres, especially of their diameter. Another disadvantage is the mounting of the wires of the spinning electrode on a pair of endless belts, which are either electrically conducting and very negatively influence an electric field created between the spinning electrode and the collecting electrode, or are electrically non-conducting and high voltage is supplied to the wires of the spinning electrodes by means of sliding contacts, preferably to one up to three wires, which makes the spinning device uselessly complicated.

The goal of the invention is to create a simple and reliable spinning electrode for a device for production of nanofibres from a polymer solution through electrostatic spinning in the electric field created between the collecting electrode and spinning electrode.

THE PRINCIPLE OF INVENTION

The goal of the invention is achieved by a rotary spinning electrode for a device for production of nanofibres through electrostatic spinning of polymer solutions, the rotary spinning electrode containing a pair of end faces, between which are positioned spinning members formed by wire, the spinning members being distributed equally along the circumference of the end faces. The principle of the invention consists in that the end faces are made of electrically non-conducting material, and all spinning members are mutually connected in an electrically conductive manner. A spinning electrode created in this manner is able to spin water as well as non-water polymer solution and along its whole length it reaches a highly uniform spinning effect, where an electric field for spinning is created between the individual spinning members after they emerge from the polymer solution and subsequently approach the collecting electrode.

Mutual electrical connection of all spinning members can be produced by the spinning members being made of one metal cord stretched alternately from one end face to another in grooves or openings arranged around the circumference of the end faces.

This can be achieved by, in a first embodiment, creating a rotary spinning electrode, where the cord on the end face either runs to a following groove or opening, through which it passes to the second end face, or, in a second embodiment, on the end face, the cord is guided crosswise into the groove or opening on an opposite side of the circumference of the end face. In the first embodiment, there is a smaller consumption of the cord, while, in the second embodiment, mutual connection of all spinning members is produced not only because they are made of one piece, but moreover by their crossing on the end faces.

In another embodiment, the spinning members are divided into pairs, each pair being formed by one metal cord and these cords being crossed on end faces.

To secure the mutual position of the end faces between which alternately run the cord or cords, that create the spinning elements of the spinning electrode, these end faces are positioned on one shaft.

More advantageous conditions of the spinning process are then achieved when using the spinning electrode in an embodiment where the electrically conductive shaft is replaced by electrically non-conducting spacing tube or the portion of the electrically conductive shaft between the end faces is covered by electrically non-conducting spacing tube.

A similar effect may also be achieved by removing the electrically conductive shaft from the space between the end faces, and through mounting of each of the end faces to an independent hinge, that is coupled with a drive of the spinning electrode. Coupling the end faces with the drive causes the end faces to rotate in the same direction and at the same speed, and ensures that the mutual position of these end faces does not change, thus also ensuring that the spinning means, mounted in grooves or holes in the end faces, remain parallel to the rotational axis of the end faces.

BRIEF DESCRIPTION OF THE DRAWINGS

The rotary spinning electrode is schematically shown in the drawings, where.

EXEMPLARY EMBODIMENTS

Figure 1:
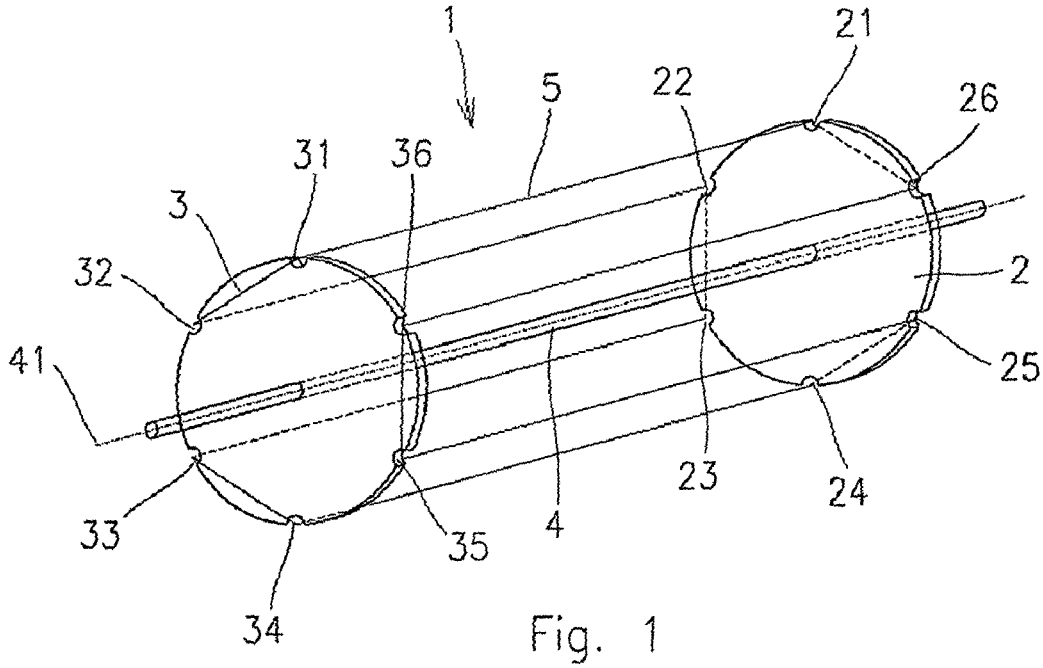
FIG. 1 shows an axonometric view of the electrode according to the invention.

In one embodiment of rotary spinning electrode 1 according to the invention the rotary spinning electrode 1 comprises two end faces 2 and 3, each being formed from a disk of electrically non-conducting material, for example plastic, mounted concentrically on a shaft 4 perpendicular to its longitudinal axis 41, which is simultaneously the axis of rotation of the shaft 4 and the spinning electrode 1. Along the whole circumference of the end face 2 there are evenly spaced radial grooves 21, 22, 23, 24, 25 and 26, and along the whole circumference of the end face 3, whose diameter is the same as the diameter of the end face 2, there are evenly spaced radial grooves 31, 32, 33, 34, 35 and 36. The radial grooves on the circumferences of the end faces 2, 3 are arranged opposite each other. In the radial grooves on the circumference of the end face 2 and in the radial grooves on the circumference of the end face 3 there is mounted a cord 5 of electrically conducting material, which is an endless loop.

The cord 5 comes out from the radial groove—e.g. 21—on the circumference of the end face 2 and runs parallel with the axis 41 of the shaft 4 into the opposite groove 31 on the circumference of the end face 3, the section of the cord 5 between the groove 21 and the opposite groove 31 creating one of the spinning elements of the spinning electrode 1.

Through the groove 31 the cord 5 passes to the outer side of the end face 3, on the opposite side from the inner side of the end face 2, and runs into the neighbouring groove 32, from which the cord 5 parallel with the axis 41 of the shaft 4 runs into the opposite groove 22 on the circumference of the end face 2. The section of the cord 5 between the groove 32 and the opposite groove 22 thus creates another spinning element of the spinning electrode 1.

By means of the groove 22 the cord 5 passes to the outer side of the end face 2, on the opposite side from the inner side of the end face 3, on which it runs into the neighbouring groove 23. From the groove 23 the cord 5 runs parallel with the axis 41 of the shaft 4 into the opposite groove 33 on the circumference of the end face 3, the section of the cord 5 between the grooves 23 and 33 creating another spinning element of the spinning electrode 1.

In the same way the cord 5 passes further through the following radial grooves 34, 35 and 36 on the circumference of the end face 3 and through the following radial grooves 24, 25 and 26 on the circumference of the end face 2, the sections of the cord 5 between the end faces 2 and 3 parallel with axis 41 creating individual spinning elements of the spinning electrode 1, the sections of the cord 5 running on outer sides of the end faces 2 and 3 to interconnect the spinning elements in a conductive manner.

Figure 2:
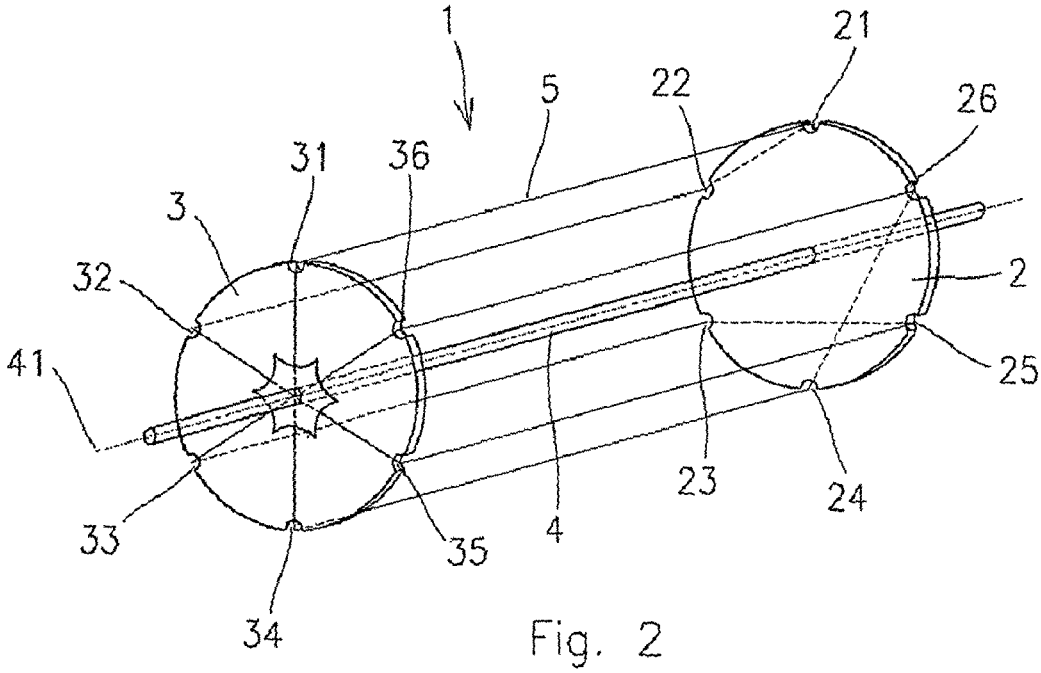
FIG. 2 shows an axonometric view of the electrode in an embodiment with spinning members formed by one cord crossing on end faces.

The cord 5 may be in radial grooves on circumference of the end face 2 and the end face 3 mounted in several further different manners, one of which is shown in FIG. 2. In this exemplary embodiment the cord 5 is, the same as in the previous example, arranged in an endless loop, while in this case due to the manner of its mounting in the radial grooves on the circumference of the end face 2 and on the circumference of the end face 3, the cord 5 is crossed over itself on the outer sides of the end faces 2 and 3.

Through a radial groove—e.g. 21—on the circumference of the end face 2 the cord 5 passes parallel with the axis 41 of the shaft 4, into the opposite groove 31 on the circumference of the end face 3, the section of the cord 5 between the grooves 21 and 31 forming one of the spinning elements of the spinning electrode 1. Through the groove 31 the cord 5 passes to the outer side of the end face 3, on the opposite side from the inner side of the end face 2, through which it runs into the groove 34 located in an opposite position on the circumference of the end face 3 from groove 31.

After passing the groove 34 the cord 5 runs parallel with the axis 41 of the shaft 4 into the opposite groove 24 on the circumference of the end face 2, the section of the cord 5 between the grooves 34 and 24 forming another spinning element of the spinning electrode 1. Through the groove 24 the cord 5 is brought to the outer side of the end face 2, on which it runs to the groove 26 on the circumference of the end face 2.

Having left the groove 26 the cord 5 runs parallel with the axis 41 of the shaft 4 and is brought into the opposite groove 36 on the circumference of the end face 3, and between the grooves 26 and 36 it forms another spinning element of the spinning electrode 1. Through the groove 36 the cord 5 is further brought to the outer side of the end face 3, on which it runs to the groove 33 located in an opposite position on the circumference of the end face 3 from groove 36, the cord 5 being crossed over itself on the end face 3.

The cord 5 from the groove 33 further runs parallel with the axis 41 of the shaft 4 into the opposite groove 23 on circumference of the end face 2, whereby the section of the cord 5 between the grooves 33 and 23 forms another spinning element of the spinning electrode 1. By means of the groove 23 the cord 5 passes to the outer side of the end face 2, on which it further runs into the groove 25 on the circumference of the end face 2, the cord 5 being crossed over itself on the outer side of the end face 2.

After passing the groove 25 the cord 5 runs parallel with axis 41 of the shaft 4 into opposite groove 35 on the circumference of the end face 3, and its section between the grooves 25 and 35 creates another spinning element. By means of the groove 35 the cord 5 is brought to the outer side of the end face 3, on which it runs into the groove 32 located in an opposite position on the circumference of the end face 3 from groove 35, so that on the end face 3 the cord 5 is crossed again over itself.

From the groove 32 the cord further runs parallel with the axis 41 of the shaft 4 into the opposite groove 22 on the circumference of the end face 2, whereby it forms another spinning element of the spinning electrode 1. Through the groove 22 the cord 5 is brought onto outer side of the end face 2, on which it is brought into the groove 21.

Not represented exemplary embodiments other than the above described embodiments represented in FIG. 1 and FIG. 2 may differ especially by mounting the cord 5 in radial grooves on the circumference of the end faces 2 and 3, where the cord 5 is always an endless loop, made of one piece, its ends being connected on one of the end faces 2, 3.

Depending on the technology of production of the nanofibres through electrostatic spinning of polymer solutions the cord 5 in a device for production of nanofibres is through a known manner connected with one pole of the not represented source of high voltage, possibly being grounded, so that on all spinning elements of the spinning electrode there is the same voltage.

Figure 3:
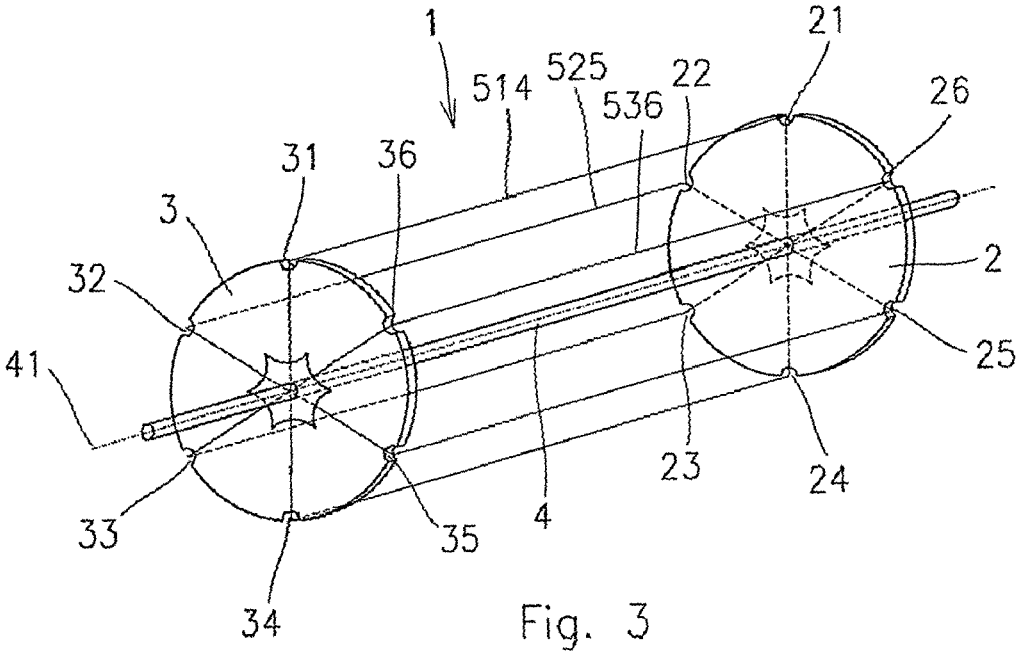
FIG. 3 shows a view of an embodiment of the electrode with spinning members divided into pairs, each pair being formed by one cord crossing over end faces of the electrode.

An exemplary embodiment of the spinning electrode 1, which is from the point of view of maintenance and possible replacement of damaged or defective spinning elements, the most suitable is represented in FIG. 3. The spinning electrode 1 is made in the same way as in the previous embodiments according to FIGS. 1 and 2 with the only difference being that the endless loop of cord 5 is, in the represented exemplary embodiment, formed by three independent endless loops 514, 525 and 536, which mutually cross each other on the end faces 2 and 3.

The cord 514 comes out from the radial groove 21 on circumference of the end face 2, and parallel with the axis 41 of the shaft 4 enters into the opposite groove 31 on circumference of the end face 3 and its section between the grooves 21 and 31 forms one of the spinning elements of the spinning electrode 1. Through the groove 31 the cord 514 is brought to outer side of the end face 3, on which it runs into the groove 34 in an opposite position on the circumference of the end face 3 from groove 31, through which it passes parallel with axis 41 of the shaft 4 into the opposite groove 24 on the circumference of the end face 2, and so creates between the grooves 34 and 24 another spinning element of the spinning electrode 1. Through the groove 24 the cord 514 is brought to the outer side of the end face 2 on which it runs into the groove 21.

In the same manner there is in radial grooves 22, 32, 25 and 35 mounted the cord 525 in an endless loop, and in radial grooves 23, 33, 26 and 36 the cord 536 is mounted in an endless loop, while on the outer sides of the end faces 2 and 3 all three cords 514, 525 and 536 are crossed, whereby their conductive connection is ensured.

In further exemplary embodiments derived from the example in FIG. 3, it is possible to create further different not represented arrangements of the cords 514, 525 and 536 creating a pair of spinning elements of the spinning electrode 1, while it is advantageous if all these cords are mutually connected in a conducting manner—e.g. by their mutual contacts. In a case when the cords are not crossed, their conducting connection is performed on the outer side of any or both end faces 2 and 3 through another known methods or means.

The cord 514 and/or cord 525 and/or cord 536 is then in dependence on the production technology of nanofibres connected in a known manner with one pole of the not represented source of high voltage, possibly being grounded.

Taking into account that during the rotation of the spinning electrode 1 (see below) electrostatic fields are subsequently created between the spinning elements of the spinning electrode 1 and the not represented collecting electrode arranged in the spinning chamber in the space above the spinning electrode 1, it is advantageous, if the shaft 4 in the space between the end faces 2 and 3 is replaced by a spacing tube of electrically non-conducting material. The spacing tube then considerably contributes not only to the screening of electric fields of opposite spinning elements of the spinning electrode 1, thus to the stabilisation of the spinning process, but also to a higher stiffness of the spinning electrode 1.

The shaft 4, possibly the spacing tube of the spinning electrode 1, according to some of the shown examples of embodiment, is in the device for production of nanofibres horizontally and rotatably mounted in the not represented reservoir of polymer solution. When some of the spinning elements on a lower side of the spinning electrode 1 on the opposite side from the collecting electrode are plunged into the polymer solution contained in the reservoir of polymer solution, in a case where the shaft 4 is replaced by a spacing tube, there is no undesired contact between the spacing tube and the polymer solution. The shaft 4, possibly the spacing tube or other part of the spinning electrode, is further in a known manner coupled with a not represented drive for rotational motion of the spinning electrode 1.

During operation of the device for production of nanofibres through electrostatic spinning of polymer solutions, the spinning electrode 1 is driven around its longitudinal axis, its spinning elements, positioned uniformly along the circumference of the end faces 2 and 3, are subsequently plunged under the level of polymer solution in the reservoir of polymer solution, and the spinning elements emerge above the level covered by the polymer solution due to the physical properties of the polymer solution. Having emerged from the polymer solution, the spinning element with polymer solution on it subsequently approaches the collecting electrode, which is in dependence on the technology of electrostatic spinning grounded or connected to a first pole of a high voltage source opposite to a second pole of the high voltage source to which the spinning elements of the spinning electrode 1 are connected. In the moment when the spinning element is sufficiently close to the collecting electrode, between it and the collecting electrode, as a result of difference of their electric potentials, there is created a sufficiently strong electric field, which along the whole length of the spinning element initiates the spinning process. During the spinning process, the polymer nanofibres are created from the polymer solution on the surface of the spinning element, which through the action of the force of the electrostatic field move towards the collecting electrode.

The spinning element remains in a position suitable for spinning of the polymer solution on its surface only for a certain time interval, whose length is adequate given the speed of rotation of the spinning electrode 1 around axis 41, and after expiry of this time interval it is moved away from the vicinity of the collecting electrode and subsequently again plunged into the polymer solution in the reservoir of polymer solution. Into the vicinity of the collecting electrode meanwhile subsequently approach further spinning elements containing the polymer solution for spinning on their surface. The spinning electrode with the described arrangement of the spinning elements thus enables a continuous production of nanofibres.

Figure 4:
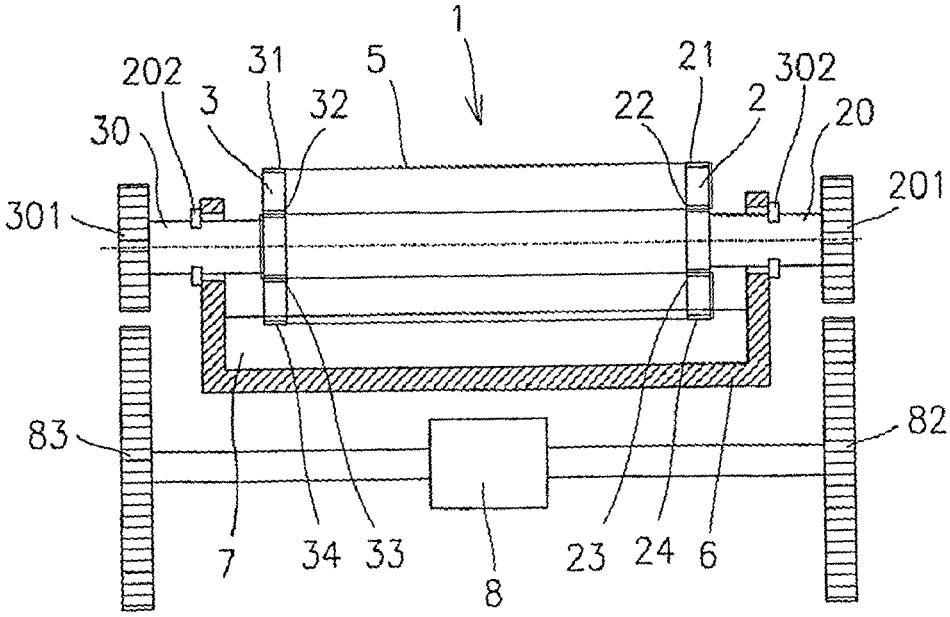
FIG. 4 shows mounting of the spinning electrode in an alternative embodiment without a shaft of the spinning electrode being in a reservoir of polymer solution.

The construction of the spinning electrode 1 nevertheless is not restricted only to the above described exemplary embodiments and their modifications. Further possibilities of arrangement of individual elements of the spinning electrode further result from the arrangement and the structure of other parts of the device for production of nanofibres. One of such exemplary embodiments is represented in FIG. 4. The spinning electrode 1 in this case comprises two end faces 2 and 3, each being formed from a disk of electrically non-conducting material.

The end faces 2 and 3 on the outer side are provided with hinges 20 and 30, which are rotatably and axially mounted in opposite walls of the reservoir 6 of polymer solution 7. At their ends the hinges 20 and 30 are provided with tooth wheels 201, 301 and their mutual axial position is secured by mounting in a known manner. In the represented exemplary embodiment, the hinges 20 and 30 are mounted by means of the distance rings 202, 302 mounted in necks in the hinges 20 and 30 and abutting against the outer wall of the reservoir 6 of polymer solution. The tooth wheels 201, 301 are coupled with driving tooth wheels 82, 83, which are coupled with the drive 8. Connection of tooth wheels 201, 301 and driving tooth wheels 82, 83 serves not only for a drive of the end faces 2 and 3 in the same direction and with the same speed, but also ensures the constant mutual position of the end faces 2 and 3, in which the corresponding grooves in both end faces 2 and 3 are arranged opposite each other, so that through these grooves pass spinning means is parallel with the rotational axis of the end faces 2 and 3. Along the whole circumference of the end face 2 there are evenly positioned radial grooves 21, 22, 23, 24, 25 and 26 and around the whole circumference of the end face 3 there are evenly positioned radial grooves 31, 32, 33, 34, 35 and 36, while through the radial grooves on the circumference of the end face 2 and the radial grooves on the circumference of the end face 3, according to some of the above described exemplary embodiments, there runs the cord 5 which is an endless loop or several cords 5 which are several endless loops.

On the basis of all of the above mentioned exemplary embodiments nearly an unlimited quantity of various more or less different variants of a spinning electrode 1 may be created, which vary from the described exemplary embodiments especially by the number of radial grooves on the circumference of the end faces 2 and 3 and, thus by the number of spinning elements of the spinning electrode 1, and possibly by the cord 5 or cords 5 not being endless loop(s), but that cord 5 or cords 5 begin and finish on an outer side of some of the end faces 2, 3. Further differences may be obtained through various embodiments of the end faces 2 and 3, which may be created in principle as any three dimensional body. The most convenient solution of the end faces 2 and 3 nevertheless seems to be the disk of electrically non-conducting material, whose edges are rounded to promote the durability and safety of the cord 5 or cords 5, and to promote the minimisation of the effect of these end faces 2 and 3 on the spinning process as well.

Another possible variant of embodiment of the spinning electrode 1 according to the invention, is obtained, when in the end faces 2 and 3 there are, instead of radial grooves, preformed openings, in which one or more cords 5 are positioned, Upon usage of the spinning electrode 1 of this structure nevertheless there occur difficulties caused especially by influence of the polymer solution, which is carried into the electrostatic field between the collecting and spinning electrode 1 on surfaces of the end faces 2 and 3. The danger of initiation of a spinning process on the end faces is avoided by suitable wiping means of the polymer solution on the end faces.

INDUSTRIAL APPLICABILITY

The spinning electrode according to the invention is applicable in a device for production of nanofibres through electrostatic spinning of water as well as non-water polymer solutions.

What is claimed is:

1. A rotary spinning electrode of an elongated shape for a device for production of nanofibres through electrostatic spinning of polymer solutions, the rotary spinning electrode comprising a pair of end faces, between which end faces are positioned spinning members formed by wire, the spinning members being distributed equally along the circumference of each of the end faces and parallel with an axis of rotation of the rotary spinning electrode, which serves to carry out the polymer solution from a reservoir of polymer solution into an electric field for spinning, wherein the end faces are made of electrically non-conducting material and all the spinning members are mutually connected in an electrically conductive manner, the wire forming at least one loop around the end faces, wherein the wire has connected ends.

2. The rotary spinning electrode according to claim 1, wherein the spinning members are formed by one metal cord stretched alternately from one end face to another in grooves or openings arranged along the circumference of the end faces.

3. The rotary spinning electrode according to claim 2, wherein the cord runs on the end face from a groove or opening to the following groove or opening, through which it passes to the second end face.

4. The rotary spinning electrode according to claim 2, wherein the cord runs on the end face from a groove or opening crosswise to the groove or opening on an opposite side of the circumference of the end face.

5. A rotary spinning electrode of an elongated shape for a device for production of nanofibres through electrostatic spinning of polymer solutions, the rotary spinning electrode comprising a pair of end faces, between which end faces are positioned spinning members formed by wire, the spinning members being distributed equally along the circumference of each of the end faces and parallel with an axis of rotation of the rotary spinning electrode, which serves to carry out the polymer solution from a reservoir of polymer solution into an electric field for spinning, wherein the end faces are made of electrically non-conducting material and all the spinning members are mutually connected in an electrically conductive manner, wherein the spinning members are divided into pairs, each of the pairs being formed from one metal cord, the cords being crossed over each other on the end faces.

6. The rotary spinning electrode according to claim 1, wherein the end faces are mounted on a shaft.

7. The rotary spinning electrode according to claim 1, wherein the end faces are mounted on an electrically non-conducting spacing tube.

8. The rotary spinning electrode according to claim 6, wherein a section of the shaft between the end faces is covered by an electrically non-conducting spacing tube.

9. A rotary spinning electrode of an elongated shape for a device for production of nanofibres through electrostatic spinning of polymer solutions, the rotary spinning electrode comprising a pair of end faces, between which end faces are positioned spinning members formed by wire, the spinning members being distributed equally along the circumference of each of the end faces and parallel with an axis of rotation of the rotary spinning electrode, which serves to carry out the polymer solution from a reservoir of polymer solution into an electric field for spinning, wherein the end faces are made of electrically non-conducting material and all the spinning members are mutually connected in an electrically conductive manner, wherein the end faces, on the outer side thereof are axially connected with hinges mounted rotatably and aligned axially on opposite walls of the reservoir of polymer solution, and wherein radial grooves or openings in the circumference of a first end face through which the spinning members may pass are arranged against radial grooves or openings in the circumference of a second end face through which the spinning members may pass, and the hinges are coupled with a drive of the spinning electrode.

* * * * *